United States Patent [19]

Rheinthal

[11] 4,354,373

[45] Oct. 19, 1982

[54] AXIAL ADJUSTMENT DEVICE FOR TAPERED INTERMEDIATE ROLLS IN A CLUSTERED MILL STAND

[75] Inventor: Peter Rheinthal, Hemer, Fed. Rep. of Germany

[73] Assignee: Sundwiger Eisenhutte Maschinenfabrik Grah & Co., Hemer-Sundwig, Fed. Rep. of Germany

[21] Appl. No.: 64,763

[22] Filed: Aug. 8, 1979

[30] Foreign Application Priority Data

Aug. 12, 1978 [DE] Fed. Rep. of Germany ..... 2835514

[51] Int. Cl.[3] ..... B21B 31/18; B21B 35/14

[52] U.S. Cl. ..... 72/247; 72/238

[58] Field of Search ..... 72/247, 237, 238, 239, 72/249

[56] References Cited

U.S. PATENT DOCUMENTS 2,776,586 1/1957 Sendzimir ..... 72/242

3,555,871 1/1971 Hlafcsak ..... 72/239

FOREIGN PATENT DOCUMENTS 955131 12/1956 Fed. Rep. of Germany .

2558582 7/1977 Fed. Rep. of Germany ..... 72/238

*Primary Examiner*—Milton S. Mehr

*Attorney, Agent, or Firm*—McAulay, Fields, Fisher, Goldstein & Nissen

[57] ABSTRACT

An axial adjustment device for use with a cluster mill stand, including tapered intermediate rolls each of which has a roll neck and a pivot bearing on the roll neck. At least one axial adjusting device is provided which is operable in an axial direction of the intermediate rolls and includes a single shift bar for each pair of intermediate rolls, and a common dog engageable with the intermediate rolls and operable in a direction transverse to the axial direction of the adjusting device, the dog being arranged at the end of the shift bar next to the roll neck for support thereof and for raising and lowering thereof in the direction transverse to the axial direction.

7 Claims, 5 Drawing Figures

AXIAL ADJUSTMENT DEVICE FOR TAPERED INTERMEDIATE ROLLS IN A CLUSTERED MILL STAND

BACKGROUND OF THE INVENTION

This invention relates to an axial adjustment device for tapered intermediate rolls in a multi-roll, or cluster mill stand.

More particularly, the invention is concerned with an axial adjustment device which comprises at least one adjusting device or mechanism operable in the axial direction of the intermediate rolls and working through an individually associated shift bar on the neck of the associated intermediate roll which is provided with a pivot bearing.

A device of this kind is prior art and described in GE-PS 955 131.

In known multi-roll or cluster mills, e.g. in a 20 roll stand, an axial shift or adjustment is applied to the intermediate rolls in order to relieve the load of the working rolls in the marginal regions of the rolled strip. In the working zone, i.e. in the zone where the rolls engage with the workpiece, the working rolls are flattened out by the rolling force, while their free ends which are not in contact with the workpiece are not subject to this load and retain their original circular cross-sectional form. Consequently, the applied rolling force increases in the region of the edges of the workpiece, leading to a higher 'draft', i.e. the edges of the workpiece are over-rolled and suffer a stronger reduction.

As a result of the provision of intermediate rolls with tapered ends, and because the intermediate rolls are axially adjustable, the working rolls can yield, or flex under increasing rolling forces in the marginal regions of the workpiece and thus avoid excess pressure loads and an over-reduction of the edge zones in the rolled strip.

In conventional mills, which have been in use for many decades, the axially effective adjusting axis or spindle is secured to one neck of the associated intermediate roll by means of a shift bar and with the interposition of a pivot bearing. In order to change the intermediate roll, which is frequently necessary, the connection between the roll neck and adjusting device must be manually operated, and, it is necessary for an operator to go to the drive side of the roll stand to perform this operation. Each of the intermediate rolls is provided with its own individually associated shift bars.

Another disadvantage with these conventional arrangements, resides in that special precautions must be taken to prevent slipping or dropping of the two upper intermediate rolls.

SUMMARY OF THE INVENTION

A primary purpose of the present invention is to develop a device which enables a much faster and simpler intermediate roll change operation and in particular to provide for the coupling of the intermediate rolls with the axial adjusting device for the intermediate rolls without manual work.

In order to accomplish the aforesaid purpose, the present invention proposes the provision of a dog which is slidable in a direction transverse to the direction of the axial movement of the axial adjusting device. The dog has the form of an upwardly open cup or shell to engage the intermediate roll and to form a single unit therewith.

As noted heretofore, the conventional intermediate roll is provided with a roll neck and a pivot bearing. The aforementioned dog provides for advantageous results when combined with the axial adjustment device for connection thereof with the tapered intermediate rolls in the multi-roll or cluster mill stands of the kind specified by virtue of the fact that the dog which is slidable in the transverse direction relative to the direction of axial adjustment is provided at the end of the shift bar which is next to the roll neck. The dog which is designed in the form of an upwardly open cup or shell provides for positive, form-fitting accommodation and support for the pivot bearing of the roll neck.

Preferably, the dog engages the bearing from beneath and is adapted to be raised and lowered in the vertical direction. The open cup or shell configuration also provides for further advantageous results in that the dogs which are associated with the upper intermediate rolls can at the same time serve as suspensions for these upper rolls so that when an intermediate roll has to be changed, no special precautions are required to prevent slipping or dropping of the upper intermediate rolls.

The required constructional outlay is particularly small if a common dog is provided for each pair of relatively adjacent intermediate rolls in a multi-roll or cluster mill stand. Accordingly, a single shift bar is provided for each pair of intermediate rolls.

In a preferred embodiment, the dog is a component part of a cylinder housing which is displaceable in a direction transversely of the direction of axial movement of the axial adjustment device, and in particular, when an associated piston thereof is secured to the shift bar. In such an arrangement, both the cylinder housing and the dog which is provided therewith can slide vertically between the frontal abutment face of the roll neck and the frontal abutment face of the shift bar.

The special advantage which is obtained with the arrangement according to the invention is that an intermediate roll change may be carried out without requiring an operator to walk over to the drive side of the roll stand. The arrangement according to the invention enables a fast and automatic roll change to be effected. The bearing cup or shell ensures an effective transmission of the required axial movement and is at the same time available as a suspension device at one end of the intermediate rolls. Consequently, there is no risk whatsoever of slipping or dropping of the upper intermediate rolls when the stand is opened up.

Other objects, advantages and the nature of the invention will become readily apparent from the detailed description of the invention described in connection with the accompanying drawing:

DESCRIPTION OF THE PREFERRED EMBODIMENTS

Figure 1:
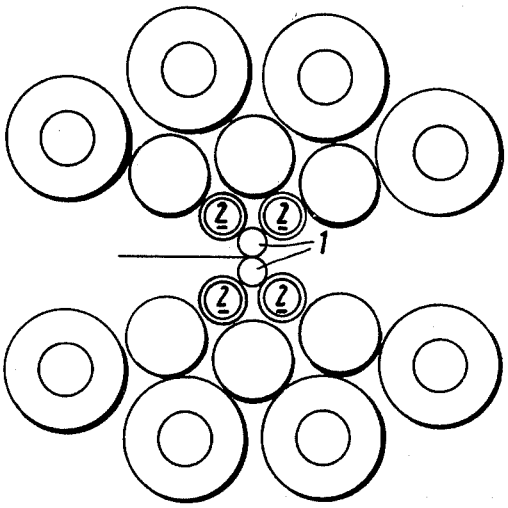
FIG. 1 is an end view of a conventional 20-roll cluster mill stand.

Referring now to the drawing, and in particular to FIG. 1, there is shown a 20-roll cluster mill stand of the per se known type or prior art. The mill includes thin working rolls 1 which are in each case supported by a pair of non-driven intermediate rolls 2.

Figure 2:
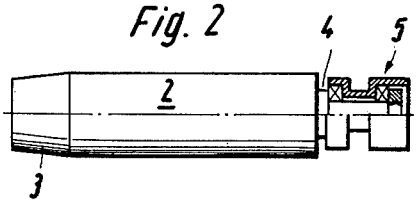
PRIOR ART Fig. 2
FIG. 2 is a longitudinal view of a conventional intermediate roll, and which is adapted to be axially adjustable along the longitudinal axis thereof.

Referring to FIG. 2, which also shows the prior art, one of these intermediate rolls 2 is shown in more detail. For camber control, the intermediate roll 2 has a tapered end portion 3. At the opposite end of the intermediate roll 2, there is provided a roll neck 4 on which a pivot bearing 5 is provided. As noted, heretofore, it is prior art to connect an intermediate roll 2 which is equipped with a pivot bearing 5 with an axially operable adjustment device in order to allow axial adjustment of the intermediate roll 2.

Figure 3:
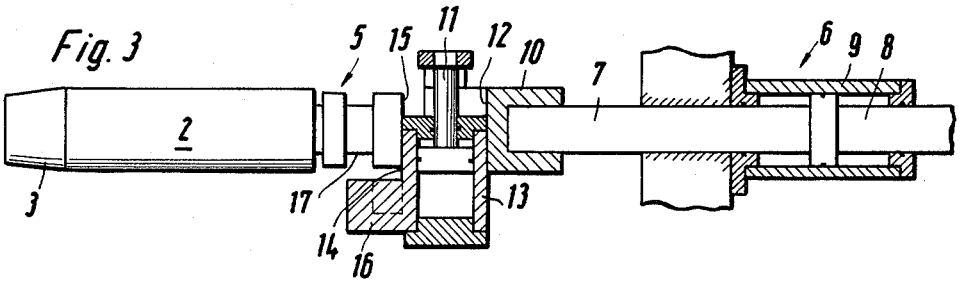
FIG. 3 is a longitudinal side view of intermediate roll of FIG. 2 in combination with the axial adjustment device partially in section according to the invention. The dog is shown in its lower position and disengaged from the roll neck of the conventional intermediate roll.
Figure 4:
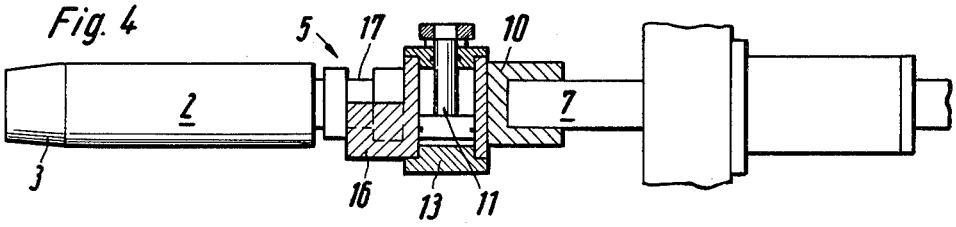
FIG. 4 is a longitudinal view similar to that of FIG. 3, but with the dog shown in its raised position and engaged with the aforesaid roll neck; and, FIG. 5 is a top view of the arrangement according to FIG. 4 showing a bridge for connection of a single axial adjustment device with two intermediate rolls and a dog for each of the two aforesaid intermediate rolls.
Figure 5:
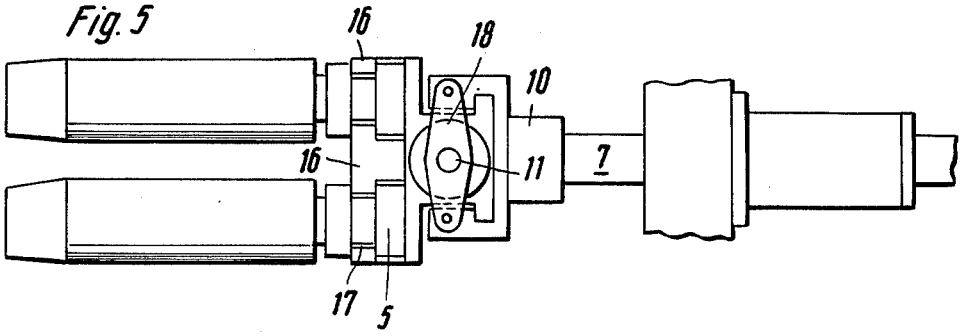

Referring now to FIGS. 3 to 5 which shows the axial adjustment device generally designated 6 operatively associated with a pair of intermediate rolls 2 and as shown in FIGS. 4 and 5 in their interconnected condition. The intermediate rolls 2 each have a frontal abutment face 15 on pivot bearing 5.

Dog part 16 is connected with the wall of cylinder 13 which forms part of a piston 11 - cylinder 13 combination. Piston 11 is connected with a bridge 18 for connecting two intermediate rolls 2 with shift bar 7 of the axial adjustment device 6.

As shown in FIG. 3, the axial adjustment device 6 comprises the shift bar 7 which is actuable by a piston-cylinder unit composed of a piston 8 and cylinder 9.

According to the present invention, a guide 10 is secured to the free end of the shift bar 7, and the piston 11 is rigidly connectly to the guide 10. The guide 10 further comprises a vertically extending guide surface 12 for the cylinder 13. The external wall 14 of cylinder 13 engages with the frontal abutment face 15 of the pivot bearing 5. This external wall 14 of cylinder 13 merges into dog part 16 which, in the illustrated embodiment of the invention has the form of an upwardly open double shell or cup and embraces the pivot bearing from below, i.e. the dog 16 engages in groove 17 of the bearing 5.

The double-shell form of the dog 16 is illustrated in FIG. 5. This figure also shows that the piston 11 is connected via bridge 18 to the guide 10 which is secured to the shift bar 7.

In the illustrated embodiment as shown in FIG. 3, the cylinder 13 with the dog 16 are in a lowered position for the introduction of new intermediate rolls 2. The new rolls 2 are fitted in the stand, and relatively aligned by actuation of the adjustment device 6. Then the cylinder 13 is raised to the position shown in FIGS. 4 and 5 so that the dog 16 engage in the groove 17 of each pivot bearing 5. The pressure of cylinder 13 is selected such that the lower intermediate rolls 2 are not raised. In the position which is shown in FIG. 4, the shift bar 7 can make the required axial adjustment or shift for the intermediate roll 2. At the next roll change, the dog 16 serves at the same time as a suspension for the upper intermediate rolls 2 when the roll cluster mill stand is opened up thereby preventing potential slipping or dropping of the upper intermediate rolls 2. All of the above described functions may be automatically controlled and monitored from the control station or platform.

While there has been shown what is considered to be the preferred mode for carrying out the invention, it will be obvious to those skilled in the art that various changes and modifications may be made therein without departing from the scope of the invention.

I claim:

1. An axial adjustment device for tapered intermediate rolls each having a roll neck at one end thereof and a pivot bearing on said roll neck in a cluster mill stand, comprising:

at least one axial adjusting device operable in an axial direction of the intermediate rolls including a shift bar for axially shifting said intermediate rolls;

engagement means on said axial adjusting device for engaging said pivot bearing;

said engagement means including means operable in a direction transverse to an axial direction of said axial adjusting device and effective to positively fit said pivot bearing and to at least partly support said one end of said intermediate roll, the positive fit being effective to provide concerted axial movement of said intermediate roll and said axial adjusting device; and said engagement means having a selectable position displaced in said transverse direction wherein it releases said pivot bearing and permits axial motion of said intermediate roll independently of said axial adjusting device.

2. An axial adjustment device for tapered intermediate rolls each having a roll neck and a pivot bearing on said roll neck in a cluster mill stand, comprising:

at least one axial adjusting device operable in an axial direction of the intermediate rolls including a shift bar for axially shifting said intermediate rolls;

a dog at an end of said shift bar having an upwardly open cup for form-fitting engagement with said pivot bearing and effective to at least partly support said pivot bearing on said roll neck; and means for displacing said dog in a direction transverse to said axial direction between a position in which said cup is disengaged from said pivot bearing to a position in which said cup engages said pivot bearing.

3. A device according to claim 1, wherein said engagement means is provided for each pair of relatively adjacent intermediate rolls.

4. A device according to claim 1 or 3, wherein said engagement means includes:

a cylinder housing moveable in a direction transversely of the direction of movement of said axial adjustment device, and a piston associated with said cylinder housing secured to said shift bar.

5. A device according to claim 4 wherein said engagement means includes a common dog for each pair of the intermediate rolls forming a component part of said cylinder housing.

6. A device according to claim 5, wherein said dog includes an upwardly open cup or shell for positive, form-fitting engagement with said neck and support of said pivot bearing on said roll neck of each of said pair of the intermediate rolls.

7. A device according to claim 1, wherein a single one of said means is provided for each said pair of intermediate rolls, and said means includes a common dog having an upwardly open cup-shaped configuration for form-fitting engagement with said neck and support of said pivot bearing.

* * * * *